US005485938A

United States Patent [19]

Boersma

[11] Patent Number: 5,485,938

[45] Date of Patent: Jan. 23, 1996

[54] CUP LID ASSEMBLY

[76] Inventor: Drew H. Boersma, 2100 Woodley Creek, Comstock Park, Mich. 49321

[21] Appl. No.: 410,059

[22] Filed: Mar. 24, 1995

[51] Int. Cl.[6] ..... A47G 19/22

[52] U.S. Cl. ..... 220/714; 220/254; 220/264; 220/373; 222/213

[58] Field of Search ..... 220/714, 715, 220/254, 264, 263, 262, 373; 215/387; 222/213

[56] References Cited

U.S. PATENT DOCUMENTS

| | | | |
|---|---|---|---|
| 3,087,656 | 4/1963 | Dougherty | 222/213 X |
| 3,964,631 | 6/1976 | Albert . | |
| 3,972,443 | 8/1976 | Albert . | |
| 4,094,433 | 6/1978 | Numbers . | |
| 4,099,642 | 7/1978 | Nergard . | |
| 4,138,033 | 2/1979 | Payne et al. . | |
| 4,212,408 | 7/1980 | Valenzona . | |
| 4,303,173 | 12/1981 | Nergard | 220/715 |
| 4,361,249 | 11/1982 | Tuneski et al. . | |
| 5,150,816 | 9/1992 | DeCastro | 220/711 |
| 5,439,146 | 8/1995 | Niss | 222/207 |

*Primary Examiner*—Gary E. Elkins
*Assistant Examiner*—Stephen Cronin
*Attorney, Agent, or Firm*—Varnum, Riddering, Schmidt & Howlett

[57] ABSTRACT

This relates to a resealable lid and cup assembly and method for using the same. The resealable lid has an opening through which liquid flows and a valve mechanism for selectively closing the opening. The valve mechanism is provided on the underside of the lid and is biased to the open position by inward deflection of the side wall of the cup.

25 Claims, 4 Drawing Sheets

CUP LID ASSEMBLY

BACKGROUND OF THE INVENTION

1. Field of the Invention

This invention relates in general to lids for conventional cups and more particularly to a valve assembly to be utilized in conjunction with the lid adapted to close an opening in the lid. The valve assembly includes an arm which extends against the wall of the cup so that one may open the valve and thus the hole in the lid so that liquid can flow out of the cup.

2. Description of the Related Art

It has long been known in the prior art to enclose a container such as a cup with a lid selectively mounted to the rim of the cup. A more recent development has been the incorporation of a lift tab or the like for providing an opening in the lid for drinking the fluid therethrough. One problem with the lift-tab type cup lids is that they are not resealable.

The known resealable cup lids have an opening formed therein for drinking the liquid therethrough but are mechanically complicated and relatively expensive to manufacture. Examples of known mechanical resealable cup lids include U.S. Pat. No. 4,094,433 to Numbers; U.S. Pat. No. 4,099,642 to Nergard; U.S. Pat. No. 4,212,408 to Valenzona; U.S. Pat. Nos. 3,964,631 and 3,972,443 to Albert; U.S. Pat. No. 4,361,249 to Tuneski et al.; and U.S. Pat. No. 4,138,033 to Payne et al.

One problem which the prior art cup lids suffer from is the complexity of the mechanical mechanism adapted to enclose the opening in the cup lid. These mechanical structures are often an assembly of several distinct elements thereby involving costly manufacturing and assembly operations. Another problem which several of the prior art cup lids suffer from is the ease of utilizing the lid mechanism.

SUMMARY OF THE INVENTION

The cup lid assembly according to the invention overcomes the problems of the prior art by simplifying the cup lid mechanism for selectively closing an opening formed in the lid and minimizing manufacturing costs.

In accordance with this invention, a lid which is secured to a conventional cup is provided with a hole and aligned with that hole is a valve member. The valve member is at one side of the cup and has an arm which contacts the cup so that the cup, which is flexible, may be pressed inwardly to effect the movement of the arm and thus movement of the valve member to an open position.

It is, therefore, an object of this invention to provide a valve mechanism which is carried by a mounting device and which is movable with respect to the opening in the lid so as open that opening and thus permit the drinking of a liquid from the associated cup without removing the lid and then reseal the opening to restrict the flow of liquid therethrough.

In another form of the invention, the valve member is part of the connecting means and the connecting means has an intermediate V-shaped portion which permits the valve member to be slid horizontally to open the opening in the lid. In this form of the invention, the V-shaped portion of the connecting member is provided with an extra projection which projects against the cup and thus when the cup is pressed inwardly, the arm serves to move the other leg of the V-shaped section horizontally.

With the above and other objects in view that will hereinafter appear, the nature of the invention will be more clearly understood by reference to the following detailed description, the appended claims, and the several views illustrated in the accompanying drawings.

BRIEF DESCRIPTION OF THE DRAWINGS

The invention will now be described with reference to the drawings in which.

DETAILED DESCRIPTION OF THE PREFERRED EMBODIMENTS

Figure 1:
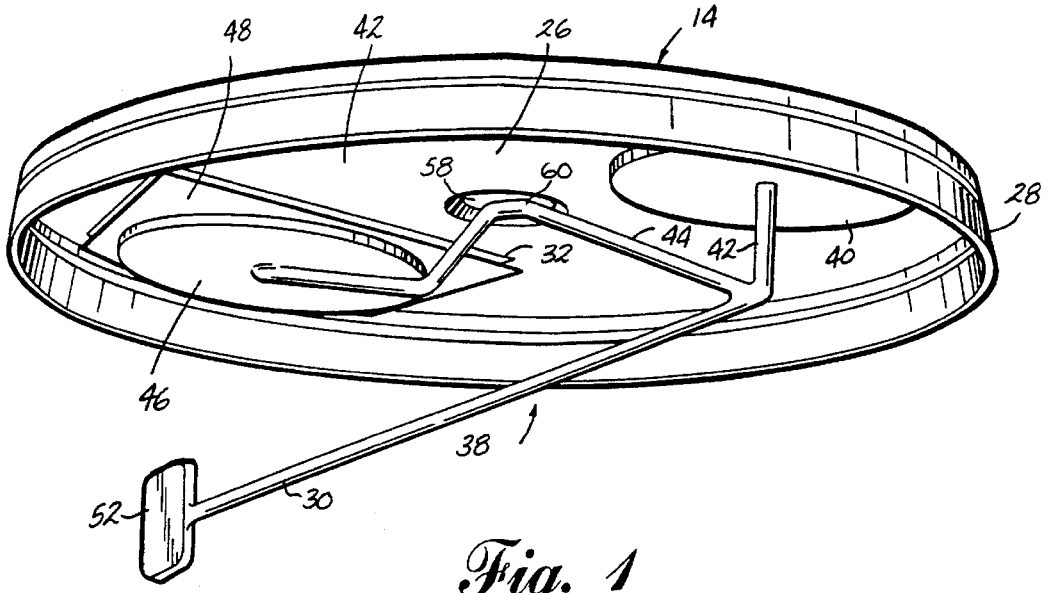
FIG. 1 is a bottom, perspective view of the bottom surface of a sealable cup lid and valve mechanism according to the invention.
Figure 2:
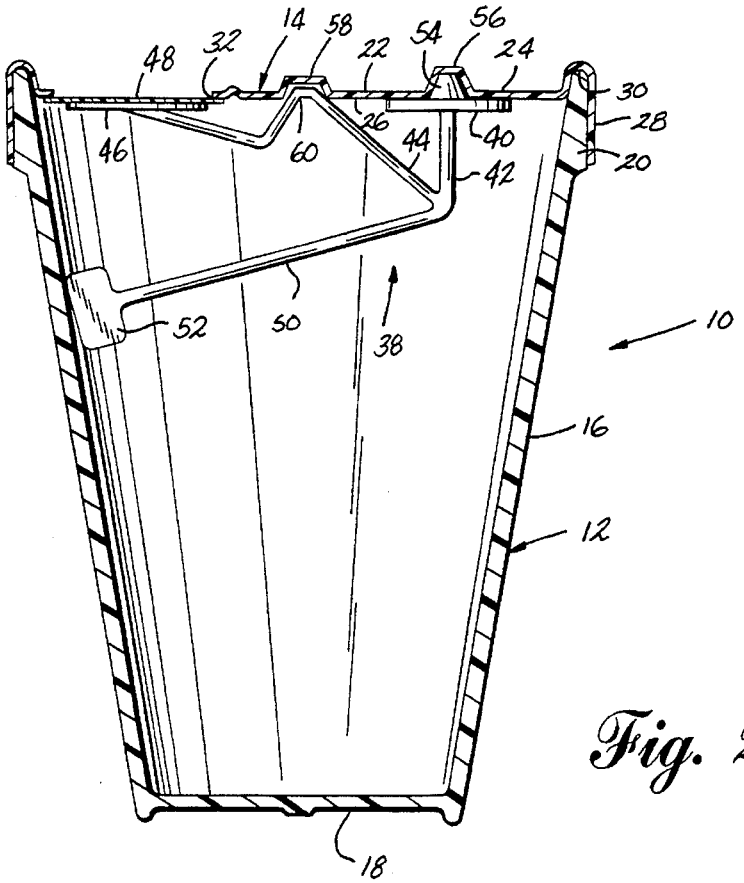
FIG. 2 is a sectional view of a cup having a sealable cup lid mounted thereon showing the valve mechanism in the sealed position.
Figure 3:
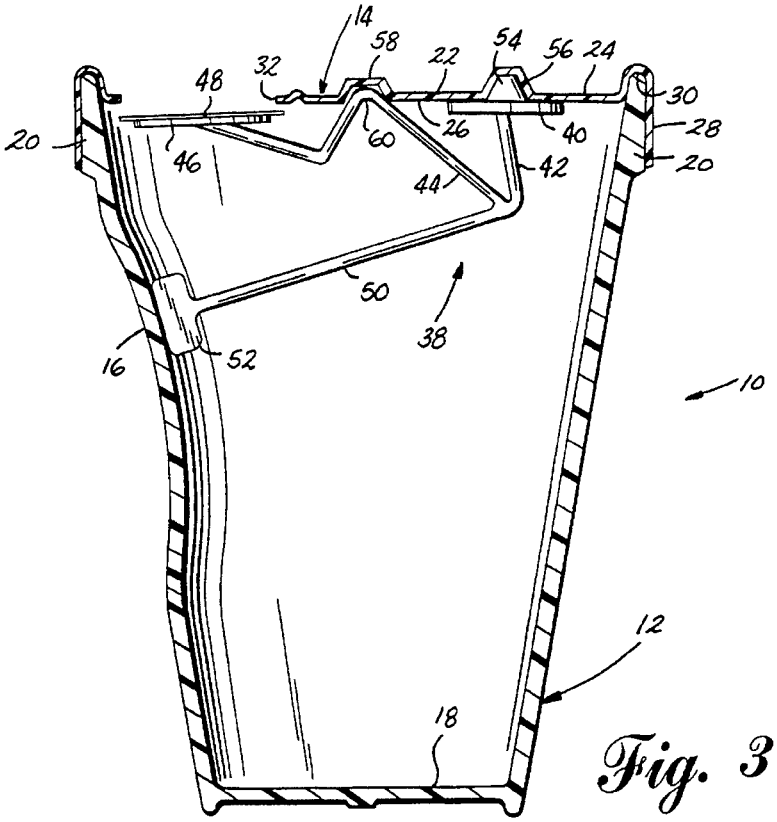
FIG. 3 is a sectional view similar to FIG. 2 showing the side wall of the cup flexed inwardly to force the valve mechanism to the open position.

Turning now to the drawings and to FIGS. 1, 2 and 3 in particular, the preferred embodiment of a cup and lid assembly 10 according to the invention is shown. The cup and lid assembly 10 comprises a cup 12 and a lid 14 selectively secured thereto. The cup 12 comprises a tapered circular side wall 16, a bottom wall 18 formed at the base of the side wall 16 and a rim 20 formed at the upper edge of the side wall 16. The lid 14 comprises a planar base 22 having a top surface 24 and a bottom surface 26. A contoured flange 28 is provided about the perimeter of the base 22 of the lid 12 and is adapted to receive the rim 20 in a recess 30 defined by the contoured flange 28. An opening 32 is formed in the base of the lid adjacent the contoured flange 28.

A valve mechanism 38 is provided on the bottom surface 26 of the lid 14 and is adapted to selectively close the lid opening 32 thereby preventing or restricting the flow of liquids therethrough. The valve mechanism 38 comprises a mounting plate 40 secured to the bottom surface 26 of the lid 14 and a lever arm 42 which extends downwardly from the mounting plate 40. A valve arm 44 extends laterally and upwardly away from the base of the lever arm 42 to a point immediately below the opening 32 of the lid 14. In the first embodiment, a mounting plate 46 is provided on the end of the valve arm 44 and a flapper valve member 48 is secured to the mounting plate 46 and adapted to cover and enclose the opening 32. As seen in FIG. 2, the dimensions of the flapper valve members 48 are larger than the opening 32 such that the opening 32 is fully enclosed by the flapper valve member 48.

The valve mechanism 38 of the first embodiment further comprises an actuator arm 50 extending laterally and downwardly from the base of the lever arm 42. Preferably, a tab 52 is provided at the terminal end of the actuator arm 50.

As seen in FIG. 2, the valve mechanism 38 is provided on the lid 14 such that when the lid 14 is properly positioned on the rim 20 of the cup 12, the tab 52 of the actuator arm 50 is positioned closely adjacent the inside surface of the cup side wall 16 and the valve arm 44 is biased upwardly such that the lid opening 32 is closed by the flapper valve member 48. The rim 20 of the cup 12 is received in the recess 30 formed by the contoured flange 28. In this condition, liquid inside the cup will not freely flow out of the lid opening 32 in the event of an accidental spill of the cup lid assembly 10.

As seen in FIG. 3, when the user desires to drink the liquid contained inside the cup, the user squeezes the cup side wall 16 immediately adjacent to the actuator arm 50 and tab 52. Radially inward movement of the cup side wall 16 at this point pushes the tab 52, actuator arm and base of the lever arm 42 radially outwardly. As the base of the lever arm 42 flexes radially outwardly, the valve arm 44, mounting plate 46 and flapper valve 48 are drawn downwardly, out of contact with the bottom surface of the lid 12 and opening 32. With the flapper valve member 48 withdrawn, liquid can easily flow through the opening 32. The opening 32 is easily closed by terminating the squeezing of the side wall 16 thereby allowing the lever arm 42 to bias the flapper valve member 48 upwardly to the closed position as seen in FIG. 2.

In the preferred embodiment, the mounting plate 40 for the valve mechanism 38 has a rigid, tapered projection 54 extending upwardly therefrom. The tapered projection 54 is received in a complementary recess 56 formed in the base 22 of the lid 14. Preferably, the tapered projection 54 and recess 56 are dimensioned such that the projection 54 is tightly, frictionally received in the recess 56. With this structure, the valve mechanism 38 and lid 14 can be shipped separately and easily assembled at a location distant from the lid and valve mechanism manufacturing facility.

Figure 4:
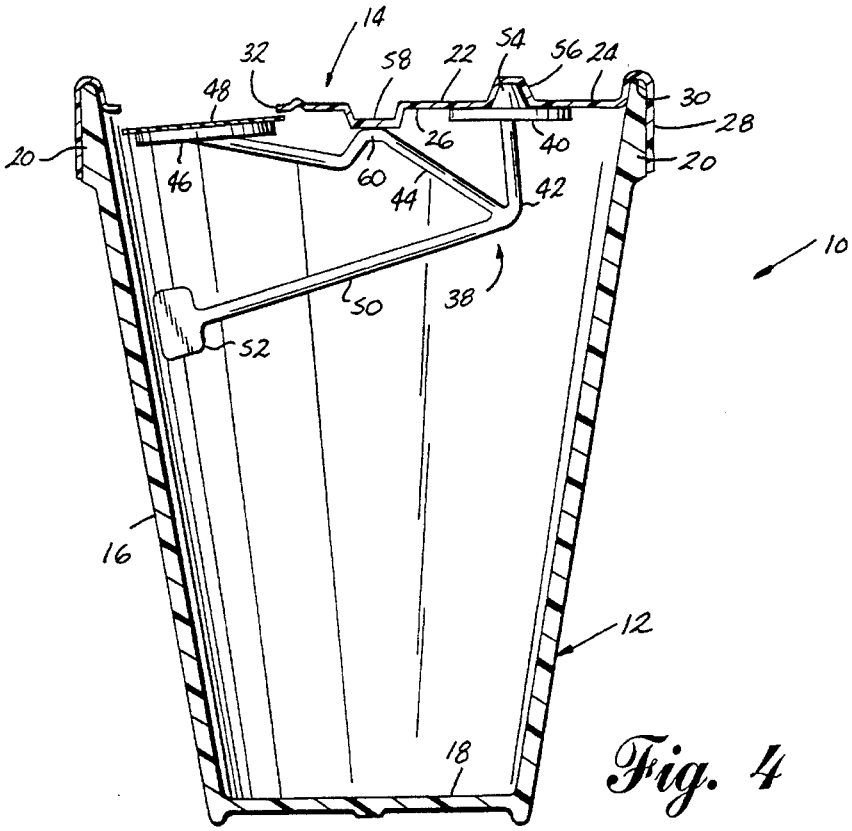
FIG. 4 is a sectional view similar to FIG. 2 showing the valve mechanism biased into the open position.

As seen above, the valve mechanism 38 is preferably biased into the closed position. However, the lid of the first embodiment is also adapted to be biased into the open position through the cooperation of the lid 14 and valve arm 44 of the valve mechanism 38. A biasing projection 58 is preferably formed in the base 22 of the lid 14 intermediate the opening 32 and the mounting point for the valve mechanism 38 of the mounting plate 40. The valve arm 44 is provided with an elbow 60 which is positioned immediately below the biasing projection 58. In use, the valve mechanism 38 is biased into the closed position preventing the flow of liquids therethrough. When the user desires to alter the orientation such that the valve mechanism 38 is constantly biased to the open position, the user merely depresses the biasing projection 58 until the upwardly extending projection is deformed into a downwardly extending projection as seen in FIG. 4. The downwardly extending biasing projection 58 contacts the elbow 60 of the valve arm 44 and depresses the valve arm downwardly, thereby lowering the flapper valve member 48 relative to the opening 32 in the lid. In this position, liquid will freely flow through the opening 32 without any need for squeezing of the side walls of the cup 12.

Figure 5:
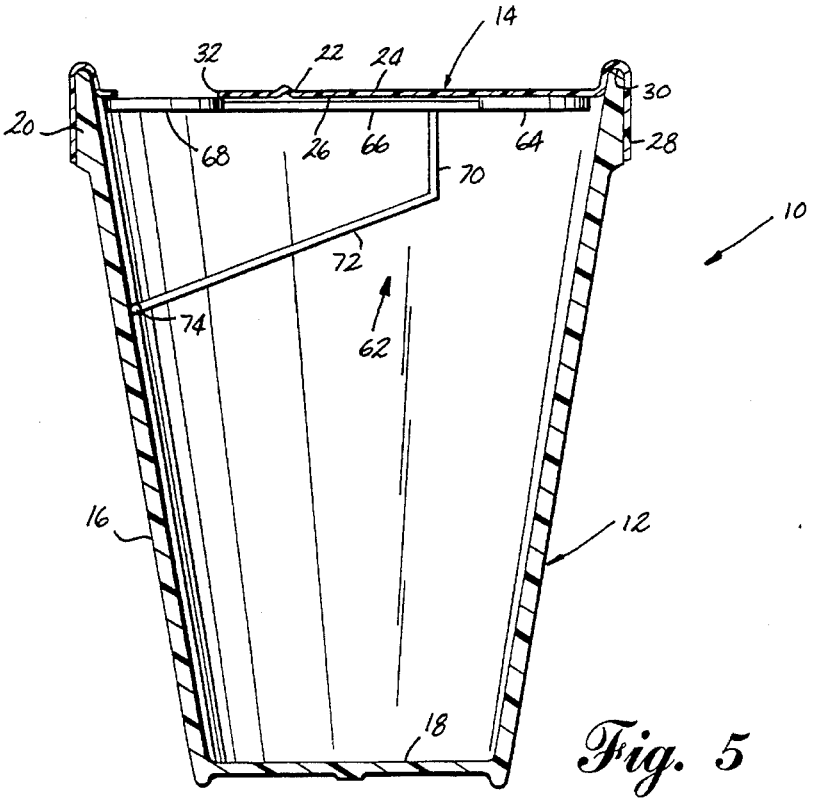
FIG. 5 is a sectional view of the cup showing a second embodiment of the valve mechanism.
Figure 6:
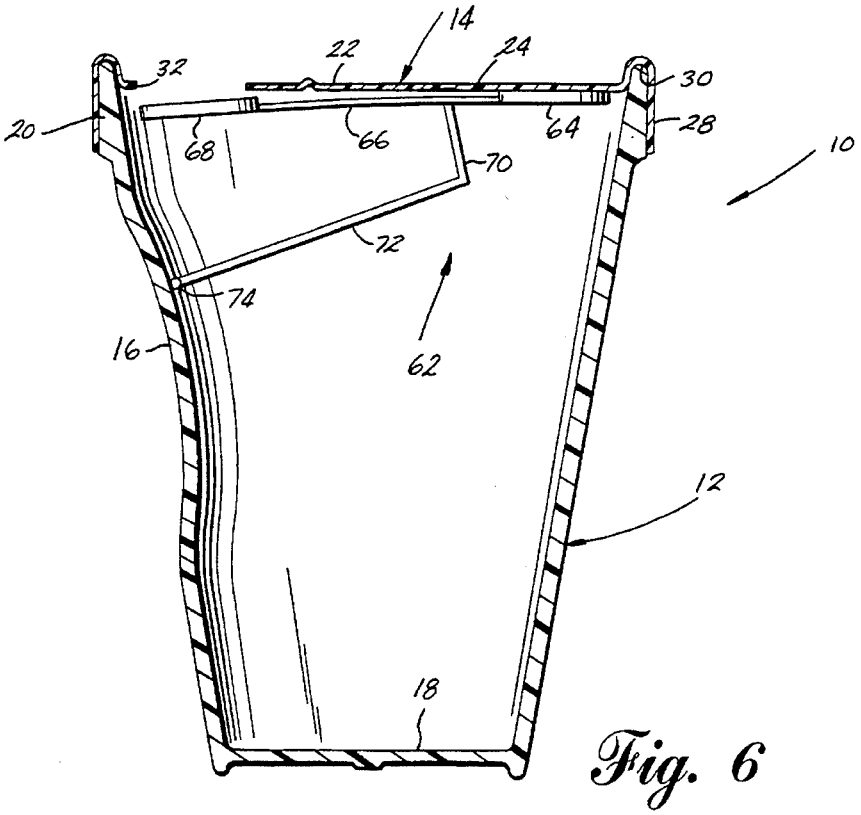
FIG. 6 is a sectional view similar to FIG. 5 showing the side wall of the cup flexed inwardly to force the valve mechanism to the open position.

FIGS. 5 and 6 show a second embodiment of the valve mechanism according to the invention. Like reference numerals for elements identical to the first embodiment will be repeated.

In the second embodiment, the valve mechanism 62 comprises a mounting plate 64 secured to the bottom surface 26 of the lid 14. A valve arm 66 extends laterally from the mounting plate 64 and a flapper valve member 68 is secured to the terminal end of the valve arm 66. A lever arm 70 extends downwardly from the valve arm 66 a spaced distance from the mounting plate 64 and an articulation arm 72 extends laterally and downwardly from the base of the lever arm 70. A ball 74 is provided on the terminal end of the articulation arm 72 and is positioned closely adjacent the inside surface of the cup side wall 16 when the lid 14 is secured to the cup 12.

As in the first embodiment, the flapper valve member 68 is withdrawn from the lid opening by deflecting the cup side wall 16 inwardly relative to the lid 14 and valve mechanism 38. As the side wall 16 is deflected inwardly, the articulation arm 72 and base of the lever arm 70 are deflected radially outwardly thereby drawing the flapper valve member 68 and valve arm 66 downwardly to permit the flow of fluid through the lid opening 32.

Figure 7:
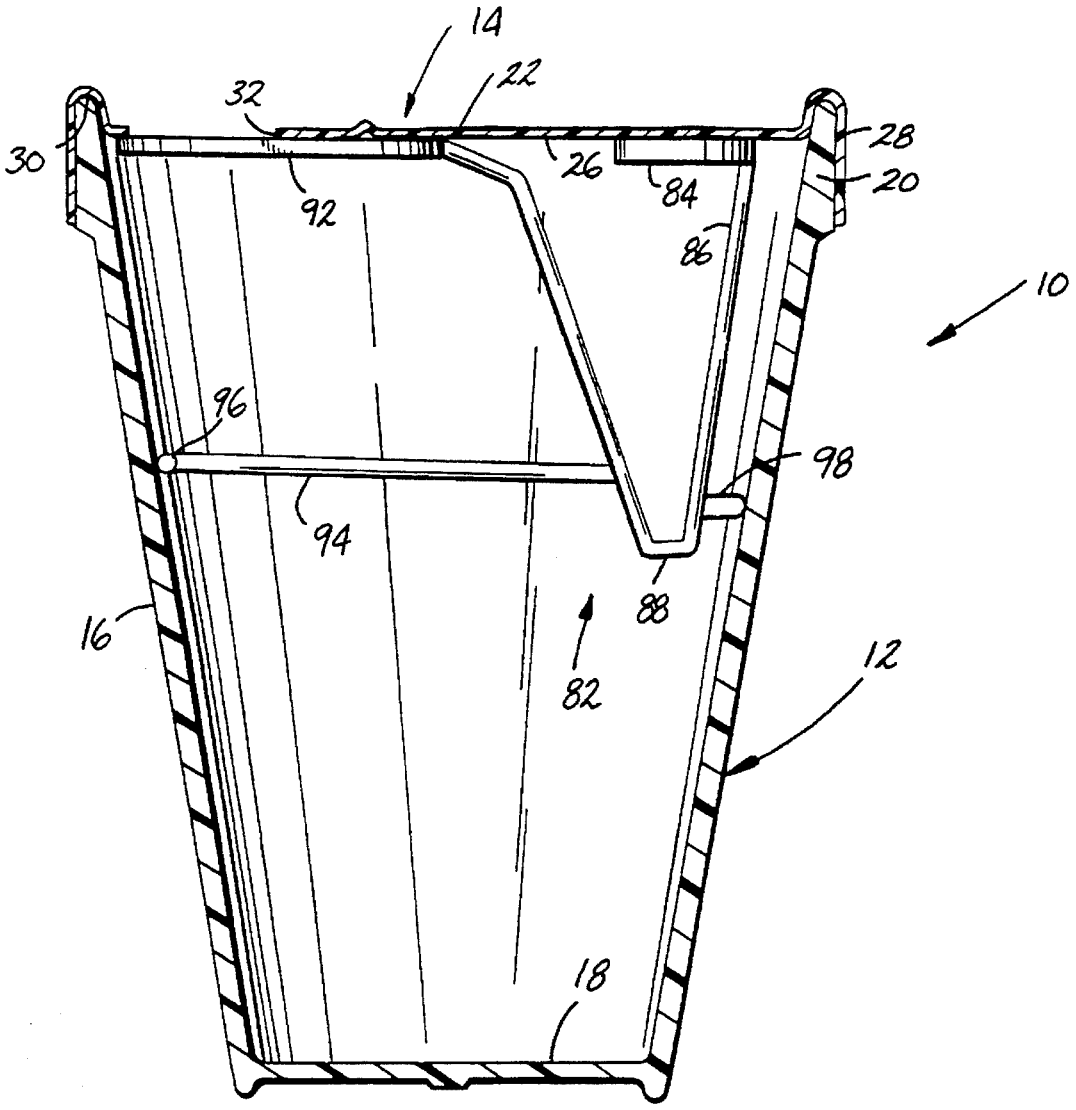
FIG. 7 is a sectional view of the sealable cup lid showing a third embodiment of the valve mechanism.

A third embodiment of the valve mechanism is seen in FIG. 7. In this embodiment, the valve mechanism 82 comprises a mounting plate 84 secured to the bottom surface 26 of the lid 14 and a first vertical arm 86 which extends downwardly from the mounting plate 84 and terminates at a base 88. A second vertical arm 90 extends upwardly and laterally from the base 88 to a point immediately adjacent the bottom surface 26 of the lid 14 and a flapper valve member 92 is secured to the second vertical arm 90. One end of an articulation arm 94 is provided on the second vertical arm 90 a spaced distance upwardly from the base 88. A rounded ball 96 is provided at the terminal end of the articulation arm 94. A support arm 98 is provided on and extends radially outwardly from the first vertical arm 86. Preferably, the support arm 98 is adjacent the base 88 and is located vertically lower than the articulation arm 94. As with the other embodiments, the valve mechanism 82 is preferably formed from a flexible, thermoplastic material.

In use, the flapper valve member 92 is removed from the opening 32 to prevent the flow of liquid therethrough by squeezing the side wall 16 of the cup 12 inwardly at a point immediately adjacent to the ball 96 of the articulation arm 94. As the side wall 16 is flexed inwardly, the articulation arm and second vertical arm 90 similarly flex laterally, effectively pivoting about the base 88. Lateral movement of the second vertical arm 90 translates into sliding movement of the flapper valve member 92 along the bottom surface 26 of the lid 14. The flapper valve member 92 is slid a sufficient distance to uncover at least a portion of the opening 32 of the lid 14 such that liquid can flow therethrough. The opening 32 is resealed by releasing the squeezing pressure on the side wall 16 of the cup 12 such that the natural bias of the valve mechanism 82 repositions the flapper valve member 92 to enclose the opening 32.

As is evident in the several embodiments, the valve mechanism can be configured such that the flapper valve member is withdrawn by downward pivoting movement of the valve member relative to the lid or by sliding movement of the flapper valve member relative to the lid. It is clear that the relative direction of movement of the flapper valve member relative to the lid is not critical to the invention. Rather, the flapper valve member must merely be biased into the closed position and easily deformable into an open position by flexure of the cup.

The lid and valve mechanism according to the invention can be manufactured by several different processes. For example, the lid can be formed by a conventional vacuum molding operation and the valve mechanism can be molded by a conventional injection molding operation. With this structure, the valve mechanism can be secured to the bottom surface of the lid by adhesive, heat staking or some other conventional fastening method. An alternative to separate manufacturing of the lid and valve mechanism would be integrally forming these two members through a conventional forming process such as injection molding. Preferably, the lid and sealable member are formed from an approved food-grade thermoplastic material. However, any material having sufficient strength yet flexible enough to permit repeated deflection thereof is suitable.

The cup and lid assembly according to the invention overcomes several problems in the prior art by utilizing a valve mechanism which is easily articulated between the open and closed position. Moreover, the lid and valve mechanism according to the invention are easily manufactured with little or no assembly of discrete elements required, thereby maintaining manufacturing costs at a minimum.

Reasonable variation and modification are possible within the spirit of the foregoing specification and drawings without departing from the scope of the invention. For example, the flapper valve member could be biased by the valve mechanism into an open position such that squeezing of the container would cause the valve member to move from the open to the closed position.

The embodiments for which an exclusive property or privilege is claimed are defined as follows:

1. A resealable cup and lid assembly comprising:

a cup having a flexible side wall and an opening provided on one end of the side wall;

a lid provided on the opening of the side wall, the lid comprising:

a base having a bottom surface;

a fluid opening provided in the base; and a valve member provided on the bottom surface of the base adapted for movement between open and closed positions, the valve member having a first arm connected to the base, a flapper valve element connected to the first arm and adapted to selectively close the fluid opening and an articulation arm having one end connected to the first arm and the other end positioned closely adjacent the flexible side wall of the cup;

wherein the valve member is moved between the closed and open positions by squeezing the cup side wall adjacent the articulation arm a sufficient distance to cause movement of the articulation arm and flapper valve element relative to the fluid opening.

2. A resealable cup and lid assembly according to claim 1 and further comprising a second arm having first and second ends, the first end being provided on the first arm and the second end of the second arm depending from the base.

3. A resealable cup and lid assembly according to claim 2 wherein the articulation arm is provided on the second arm adjacent the first end.

4. A resealable cup and lid assembly according to claim 2 wherein the first arm has first and second ends, the first end being provided on the second arm adjacent the first end and the flapper valve element being provided on the second end of the first arm.

5. A resealable cup and lid assembly according to claim 2 and further comprising a mounting member provided on the second end of the second arm, the mounting member being securely fastened to the bottom surface of the base member.

6. A resealable cup and lid assembly according to claim 1 wherein the length and width dimensions of the flapper valve element are greater than the length and width dimensions of the fluid opening such that the flapper valve element completely closes the fluid opening when the valve member is in the closed position.

7. A resealable cup and lid assembly according to claim 1 wherein the base has a peripheral edge and the fluid opening is spaced radially inwardly from the peripheral edge.

8. A resealable cup and lid assembly according to claim 1 and further comprising a second arm having first and second ends, the first end being connected to the first arm and the second end of the second arm being mounted to the base wherein the one end of the articulation arm is provided on the second arm a spaced distance from the second end such that flexing of the cup side wall and the articulation arm results in movement of the flapper valve element between the closed and open positions.

9. A resealable cup and lid assembly according to claim 8 and further comprising a stop provided on and extending laterally from the second arm adjacent the first end, the stop being adapted to restrict the lateral movement of the second arm in response to flexing of the cup side wall and articulation arm.

10. A resealable cup and lid assembly according to claim 1 and further comprising a selectively deformable biasing projection extending outwardly from the base and adapted to be deformed between first and second positions, the biasing projection being further adapted in one of the first and second positions to contact and deflect the first arm such that the valve is in the open position.

11. A resealable cup and lid assembly according to claim 1 and further comprising a mounting projection connected to the first arm and a complementary recess formed in the lid wherein the mounting projection is received in the complementary recess for mounting the valve member to the lid.

12. A resealable lid for use with a cup having flexible side walls, the lid comprising:

a base having a bottom surface;

a fluid opening provided in the base; and a valve member provided on the bottom surface of the base adapted for movement between open and closed positions, the valve member having a first arm connected to the base, a flapper valve element connected to the first arm and adapted to selectively close the fluid opening and an articulation arm having one end connected to the first arm and the other end adapted to be positioned closely adjacent the side wall of the cup;

wherein the valve member is moved between the closed and open positions by squeezing the cup side wall adjacent the articulation arm a sufficient distance to cause movement of the articulation arm and flapper valve element relative to the fluid opening.

13. A resealable lid according to claim 12 and further comprising a second arm having first and second ends, the first end being provided on the first arm and the second end depending from the base.

14. A resealable lid according to claim 13 wherein the articulation arm is provided on the second arm adjacent the first end thereof.

15. A resealable lid according to claim 14 wherein the first arm has first and second ends, the first end being provided on the second arm adjacent the first end and the flapper valve element being provided on the second end of the first arm.

16. A resealable lid according to claim 12 wherein the base has a peripheral edge and the fluid opening is spaced radially inwardly from the peripheral edge.

17. A resealable lid according to claim 13 wherein the first arm depends from the second arm at a point intermediate the first and second ends of the second arm.

18. A resealable lid according to claim 12 and further comprising a second arm having first and second ends, the first end being provided on the first arm and the second end of the second arm depending from the base wherein the one end of the articulation arm is provided on the second arm a spaced distance from the second end such that flexing of the cup side wall and articulation arm results in sliding movement of the flapper valve element between the closed and open positions.

19. A resealable lid according to claim 18 and further comprising a stop provided on and extending laterally from the second arm adjacent the first end, the stop being adapted to restrict the lateral movement of the second arm in response to flexing of the cup side wall and articulation arm.

20. A resealable lid according to claim 12 wherein the valve member is integrally molded to the base.

21. A resealable lid according to claim 12 wherein the valve member is mechanically attached to the base.

22. A resealable cup and lid assembly according to claim 12 and further comprising a selectively deformable biasing projection extending outwardly from the base and adapted to be deformed between first and second positions, the biasing projection being further adapted in one of the first and second positions to contact and deflect the first arm such that the valve is in the open position.

23. A resealable cup and lid assembly according to claim 12 and further comprising a mounting projection connected to the first arm and a complementary recess formed in the lid wherein the mounting projection is received in the complementary recess for mounting the valve member to the lid.

24. A method of using a resealable cup and lid assembly comprising the steps of:

providing a cup having a flexible side wall and an opening on one end of the side wall;

providing a lid on the opening of the side wall, the lid comprising:

a base having a bottom surface;

a fluid opening provided in the base; and a valve member provided on the bottom surface of the base adapted for movement between open and closed positions, the valve member having a first arm connected to the base, a flapper valve element connected to the first arm and adapted to selectively close the fluid opening and an articulation arm having one end connected to the first arm and the other end adapted to be positioned closely adjacent the flexible side wall of the cup;

squeezing the side wall of the cup radially inwardly adjacent the other end of the first arm a sufficient distance to cause the valve member to move from one of the closed and open positions to the other of the closed and open positions.

25. A method of using a resealable cup and lid assembly according to claim 24 and further comprising the step of terminating the squeezing of the side wall of the cup such that the valve member moves from said other of the closed and open positions to said one of the open and closed positions.

* * * * *